United States Patent [19]

Imoto

[11] Patent Number: 4,965,240

[45] Date of Patent: Oct. 23, 1990

[54] IMAGE-RECEIVING SHEET

[75] Inventor: Kazunobu Imoto, Tokyo, Japan

[73] Assignee: Dai Nippon Insatsu Kabushiki Kaisha, Japan

[21] Appl. No.: 307,475

[22] Filed: Feb. 8, 1989

[30] Foreign Application Priority Data

Feb. 12, 1988 [JP] Japan ..... 63-30594

[51] Int. Cl.[5] ..... B41M 5/035; B41M 5/26

[52] U.S. Cl. ..... 503/227; 8/471; 428/195; 428/207; 428/323; 428/409; 428/913; 428/914

[58] Field of Search ..... 8/471; 428/913, 914, 428/195, 207, 323, 409; 503/227

[56] References Cited

U.S. PATENT DOCUMENTS 4,720,480 1/1988 Ito et al. ..... 503/227

FOREIGN PATENT DOCUMENTS 1237693 10/1986 Japan ..... 503/227

*Primary Examiner*—Bruce H. Hess

*Attorney, Agent, or Firm*—Arnold, White & Durkee

[57] ABSTRACT

An image-receiving sheet to be used in combination with a heat transfer sheet containing a dye which is migrated by melting or sublimation with heat having a receiving layer for receiving the dye migrated from the heat transfer sheet formed on the surface of the substrate sheet. The receiving layer has dyeability, and the surface reflection characteristics of the surface where the receiving layer is coated having the values L, a and b as measured by the method defined by JIS-Z8722 and represented by JIS-8730 within the ranges of L=85 or more, a=−1.5 to +2.0 and b=−1.5 to 0, respectively.

6 Claims, No Drawings

IMAGE-RECEIVING SHEET

BACKGROUND OF THE INVENTION

This invention relates to a transfer material to be used for image formation according to the heat-sensitive transfer system, particularly to an image-receiving sheet to be used in combination with a heat transfer sheet.

It has been known in the art to obtain an image-receiving sheet by forming a receiving layer by applying and drying a composition for formation of a receiving layer directly or after formation of an undercoat layer or intermediate layer on a substrate sheet.

However, the image-receiving sheet of the prior art does not exhibit satisfactory whiteness of the image-receiving layer, and therefore a color image of high sharpness cannot be obtained easily. Additionally, and also the whiteness of the image-receiving layer is liable to be further lowered by change with lapse of time, whereby there has been the drawback that sharpness of the image immediately after transfer onto the image-receiving sheet cannot be maintained easily.

The composition for formation of the receiving layer used in the prior art comprises generally a thermoplastic resin. These thermoplastic resins, when degradated with heat or light, tend to be degraded in tone by coloration in yellow.

Whereas, as the method for determinating quantitatively the tone of such subject matter, there is the method as defined in JIS-Z8722 and JIS-Z8730.

According to the method as defined in JIS-Z8722 and JIS-Z8730, the tone of a subject matter to be measured is represented by the three values of L, a and b. Here "L" represents lightness, and exhibits higher lightness as this value is greater. On the other hand, "a" represents reddishness, and exhibits stronger reddishness as the value is greater, and deficiency of reddishness when it becomes - (minus), in other words stronger greenishness. Further, the value "b" is an index of yellowishness, and exhibits stronger yellowishness as this value is greater, and deficiency of yellowishness when it becomes - (minus) to become blueish. Colorelessness is indicated when both of a and b are zero.

Whereas, for preventing the inevitable problems of coloration of the image-receiving sheet of the prior art as described above, first, one may consider to add a white pigment in the receiving layer. In this case, the reflectance of the surface can become higher to some extent (namely, L value is increased), but according to this method, the b value becomes also higher, thereby ensuing a new problem of being tinted with yellowishness. For this reason, it appears that whiteness is visually rather lowered. By use of such an image-receiving sheet, the image portion, particularly the highlighted portion, becomes yellowish to lose sharpness, whereby the value as image-receiving sheet cannot but be lowered.

SUMMARY OF THE INVENTION

The present invention has been accomplished in view of the problems of the prior art as described above, and it is intended to provide an image-receiving sheet having excellent whiteness.

The present inventors, as the result of various experiments, have found that it is effective to add a blue colorant into the image receiving layer as the method for shielding the colorations into yellowishness. However, according to this method, although the yellowishness itself can be effectively shielded, with an increase of the amount of the blue colorant added, the value is reduced to increase greenishness, and when the amount added is further increased, the receiving layer exhibits blueishness to become a color which can be said to be white with difficulty. The present inventors, as the method for shielding such greenishness, have found a method to add a red or violet colorant. According to this method, it is possible to obtain an image-receiving sheet which has very excellent visual whiteness and is particularly suitable for the heat transfer system.

Further, as the result of investigations about the tone of the receiving image by suitably varying the kinds and amounts of blue, red and white colorants, it has been found that very excellent visual whiteness can be exhibited when the values of the above L, a and b are within specific ranges.

The image-receiving sheet of the present invention has been accomplished on the basis of the above findings, and it is an image-receiving sheet to be used in combination with a heat transfer sheet containing a dye which is migrated by melting or sublimation with heat. The sheet has a receiving layer for receiving the dye migrated from the heat transfer sheet formed on the surface of the substrate sheet, said receiving layer has dyeability, and the surface reflection characteristics of the surface where the receiving layer is coated have the values of L, a and b, as measured by the method defined by JIS-Z8722 and represented by JIS-8730, within the ranges of $L=85$ or more, $a=-1.5$ to $+2.0$, and $b=-1.5$ to 0, respectively.

DETAILED DESCRIPTION OF THE INVENTION

The above reflection characteristic values L, a, b are obtained according to the methods defined by JIS-Z8722 and JIS-Z8730, and according to the definitions, the tone of the subject to be measured is represented by the three values of L, a and b. Here, L represents lightness and exhibits higher lightness as this value is greater. On the other hand, represents reddishness and exhibits deficiency of reddishness if it becomes (minus), in other words, stronger greenishness. Further, b is an index of yellowishness and exhibits strong yellowishness when this value is great, while exhibits deficiency of yellowishness to become blueish when it becomes - (minus). Colorlessness is indicated when both of a and b are 0.

Of the above values, L representing lightness is not directly related to tone, but when L becomes lower, visual "brilliancy" is lost in whiteness. Accordingly, for obtaining a light image as the image-receiving sheet, L should be desirably 85 or higher.

If the value of a is less than $-1.5$, the color is undesirably tinted visually with greenishness, while if it exceeds $+2.0$, the color is undesirably tinted visually with reddishness.

Further, if the value of b is less than $-1.5$, the color is undesirably tinted visually with blueishness, while if it exceeds 0, the color is tinted visually with reddishness.

In the present invention, various colorants are added in combination so that the surface reflection characteristics may take the values as defined above. As the colorants to be added for such purpose, there are white pigments, blue dyes, and red dyes. Further, in addition to these, fluorescent brighteners can be added.

In the present invention, by adding the above colorants in the intermediate which may be sometimes formed between the substrate sheet and the receiving layer, or in both of the intermediate layer and the receiving layer, the surface reflection characteristics can be consequently controlled to the values as specified above.

As the substrate sheet for the image-receiving sheet of the present invention, any materials known in the art can be used, as far as the above mentioned surface reflection characteristics are not destroyed. For example, papers, synthetic resin sheets, ceramics, metal sheets, etc. which can function as the substrate sheet can be used. In more detail the following materials, such as synthetic paper (polyolefine type, polystylene type, etc.); natural fiber paper such as cellulose fiber paper (wood-free paper, coated paper, latex impregnated paper, etc.); synthetic resin sheet or film (polyolefine, polyvinyl chloride, polyethylene-terephtharate, polystylene, polymethacrylate, polycarbonate, etc.), and white opaque film, formed sheet produced by stretching above synthetic resin with addition of white pigment or fillers; an extrusion coating or dry laminate product by cellulose fiber paper and above synthetic resin; can be used.

Examples of the resin to be used for the receiving layer may include polyester, polyacrylate, polycarbonate, polyvinyl acetate, styrene-acrylate resin, vinyl tolueneaacrylate resin, polyurethane, polyamide, urea resin, polycaprolactone, styrene-maleic anhydride resin, polyvinyl chloride, polyacrylonitrile, etc. and mixtures, copolymers of these resins, and others.

The resins to be used in these receiving layer are mostly slightly colored even in the case of transparent resins, and most of them are tinted with yellowishness. However, in the present invention, if such a faint color resin may be used, good whiteness can be obtained by controlling the amounts of the additives.

Also, by use of these methods, even if the substrate may have comparatively low whiteness, an image-receiving sheet with good whiteness can be obtained. In this case, the substrate with the surface reflection characteristics of the surface having the respective values of L, a and b as measured by the method defined by JIS-Z8722 and represented by JIS-8730 within the range of $L=90$ or more, $a=-2.0$ to $+2.0$, $b=-7.0$ to 1.0 may be preferably used.

In the present invention, when an intermediate layer is formed, the following materials can be used as the material for the intermediate layer:

polyurethane resin;
polybutadiene resin;
polyacrylate resin;
epoxy resin;
polyamide resin;
rosin-modified phenol resin;
terpene phenol resin;
ethylene/vinyl acetate copolymer resin;
styrene/butadiene copolymer, etc.

The above resins can be used as a single kind or as a mixture of two or more kinds.

In the following, the colorants to be added in the receiving layer or (and) the intermediate layer are described.

As the white pigment, there can be used inorganic pigments such as titanium oxide, zinc oxide, barium sulfate, and alumina white, etc., extender pigments such as kaolin clay, silica, magnesium carbonate and calcium carbonate, etc., either alone or in combination, and by addition of these into the receiving layer or (and) the intermediate layer, whiteness can be enhanced simultaneously with improvement of shielding characteristic.

Of the above pigments, typical titanium oxide may include, KA-10, KA-20, KA-30, KA-35, KA-60, KA-80, KA310, etc. (all are anatase type titanium oxides), KR310, KR-380, KR-460, KR-480, etc. (all are rutile type titanium oxides) produced by Titanium Kogyo K.K., Japan, while as kaolin clay, JP-100 kaolin, 5M kaolin, NN kaolin, Hardsil, ST kaolin, etc. produced by Tsuchiya Kaolin K.K. are commercially available.

As specific examples of blue dyes, Kaset Blue N (manufactured by Nippon Kayaku, Japan), Kaset Blue FR (manufactured by Nippon Kayaku), Kaset Blue A-CR (manufactured by Nippon Kayaku), Kaset Blue 714 (manufactured by Nippon Kayaku), Waksoline Blue AP-FW (manufactured by ICI), Foron Brilliant Blue S-R (manufactured by Sand), MS Blue 100 (manufactured by Mitsui Toatsu, Japan), Daito Blue No. 1 (manufactured by Daito Kagaku, Japan), etc. can be used. As the red dyes, MS Red G (manufactured by Mitsui Toatsu Kagaku), Macrolex red violet r. (manufactured by Bayer), SK Rubin SEGL (manufactured by Sumitomo Kagaku, Japan) etc. may be employed.

As the blue or red colorant, inorganic pigments or organic pigments such as phthalocyanine pigments, azo pigments, and the like can be used. For example, as phthalocyanine blue pigments, Heliogen Blue LBG manufactured by BASF, Heliogen Blue BR manufactured by BASF, etc. may be employed, and as azo red pigments, Helio Fast Red BN manufactured by BASF, Helio Fast Red FG, manufactured by Bayer, etc. may be employed.

Calling attention on the kind of dyes, dispersable dyes, acidic dyes, premetalized dyes and direct dyes may be suitably used.

As the foluorescent brightener to be selectively added, stilbene type, distilbene type, benzoxazole type, styryl-oxazole type, pyrene-oxazole type, coumarine type, imidazole type, benzoimidazole type, pyrazoline type, aminocoumarine type, distyryl-biphenyl type fluorescent brighteners can be employed, and these fluorescent brighteners can be used as a mixture of one or more kind. Specific examples of these fluorescent brighteners may include Uvitex-OB, Uvitex EBF, Uvitex-ERN-P (all are benzoxazole type), Uvitex-EHF (styryloxazole type), Unitex-EMT, Uvitex-EMV (all are pyrene oxazole type), Uvitex ERT (coumarin type), Uvitex-AT (imidazole type), Uvitex-BAC (benzimidazole type), Uvitex-WG (pyrazoline type), Uvitex-WGS (aminocoumarine type), Uvitex-2B, Uvitex-BHT, Uvitex-MST, Uvitex-CF (all are stilbene type), Uvitex NFW (distyryl-biphenyl type), etc. manufactured by CIBA-GEIGY, Kayacall-BS-conc, Kayacall-BIconc, Kayacall-BIL, Kayacall-BRA, Kayacall-BRAL, Kayacall-BRBLconc, Kayacall-BUL, Kayacall-BXconc, Kayacall-BXNL, Kayacall-BZconc, Kayacall-BZH/C, Kayacall-BZL, Kayacall-CAconc, Kayacall-CPL, Kayacall-KTL, Kayacall-PAN, Kayacall-PKconc, Kayacall-RG, Kayacall-RP, Kyyacall-SR, Kayacall-WG, Kayacall-WS, Kayacall-WSL-100, Kayacall-E, Kayacall-C, etc. manufactured by Shinnisso Kako K.K., Japan can be used. Further, Kayalight OSR, Kayalight OS, Kayalight B (all produced by Nippon Kayaku) can be used. Otherwise, Eastobrite OB-1 (manufactured by Eastman Chemicals) is also commercially available.

The present invention is described below by referring to Examples.

EXAMPLE 1

By use of a synthetic paper having the colorimetric data of L=92.26, a=−1.05 and b=0.95 (Yupo-FGP-150 (trade name) manufactured by Oji Yuka, Japan) as the substrate sheet, a coating composition for receiving layer comprising the composition (A) shown below and containing an anatase type titanium oxide (KA-10, manufactured by Titanium Kogyo), a benzoxazole type fluorescent brightener (Uvitex OB, manufactured by CIBA-GEIGY), a blue dye (Kayaset Blue-N, manufactured by Nippon Kayaku) and a red dye (Macrolex red Viotet R, manfactured by Bayer) in amounts shown in Table 1 was applied on the surface by wire bar coating to a thickness of drying of 5 microns to form an image-receiving sheet. Drying was conducted after tentative drying by a dryer in an oven of 130° C. for 3 minutes.

Coating composition for receiving layer (A):

| | |
|---|---|
| Polyester resin (Vylon 600, manufactured by Toyobo, Japan) | 6.6 wt. parts |
| Polyvinyl chloride acetate (#1000 A, manufactured by Denki Kagaku, Japan) | 9.0 wt. parts |
| Amino-modified silicone oil (X-22-3050C, produced by Shinetsu Kagaku, Japan) | 0.3 wt. parts |
| Epoxy-modified silicone oil (X-22-3000E, produced by Shinetsu Kagaku, Japan) | 0.3 wt. parts |
| Toluene | 42.2 wt. parts |
| Methyl ethyl ketone | 42.2 wt. parts |

L, a and b values of the image-receiving sheet obtained as described above were measured by SM color computer (Model SM-4CH, manufactured by Suga Shikenki, Japan). The measured values are shown in Table 1.

TABLE 1

| No. | White pigment (wt. parts) | Blue dye (wt. parts) | Red dye (wt. parts) | L | a | b | Visual Judgement |
|---|---|---|---|---|---|---|---|
| 1 | 0 | 0 | 0 | 94,38 | −0.95 | 2.02 | tinted with yellowishness |
| 2 | 0.75 | 0 | 0 | 95.52 | −0.45 | 2.98 | tinted with yellowishness |
| 3 | 0 | 0.01 | 0 | 93.11 | < −4.02 | −4.62 | tinted with blueishness |
| 4 | 0 | 0.003 | 0.003 | 90.51 | −0.29 | −3.89 | good whiteness |
| 5 | 0.75 | 0.01 | 0 | 93.56 | > −3.82 | −3.03 | tinted with blueishness |
| 6 | 0.75 | 0.003 | 0.003 | 92.50 | 0.12 | −3.52 | good whiteness |

As is apparent from the above results, both of No. 4 and No. 6 included within the range of the present invention exhibited good whiteness characteristics.

EXAMPLE 2

On the same substrate sheet as in Example 1, an intermediate layer comprising the composition shown below was applied by wire bar coating to thickness of 45 microns on drying, and the same coating composition for receiving layer was applied in the same manner as in Example 1, and dried to form an image-receiving sheet. The dyes and pigments employed were the same as in Example 1.

Intermediate layer:

| | |
|---|---|
| Styrene-butadiene coplymer (Kaliflex TR1101, produced by Shell Chemical) | 15 wt. parts |
| Toluene | 85 wt. parts |
| Pigment and dye as shown in Table 2 | |

The measured values measured according to the same methods as in Example 1 are shown in Table 2.

TABLE 2

| No. | White pigment (wt. parts) | Blue dye (wt. parts) | Red dye (wt. parts) | L | a | b | Visual Judgement |
|---|---|---|---|---|---|---|---|
| 1 | 0 | 0 | 0 | 93.59 | −0.03 | 2.42 | tinted with yellowishness |
| 2 | 0.75 | 0 | 0 | 95.40 | −0.50 | 3.02 | tinted with yellowishness |
| 3 | 0 | 0.01 | 0 | 92.01 | −4.05 | −4.01 | tinted with blueishness |
| 4 | 0 | 0.01 | 0.01 | 90.10 | −0.36 | −3.50 | good whiteness |
| 5 | 0.75 | 0.01 | 0 | 94.15 | −3.86 | −3.63 | tinted with blueishness |
| 6 | 0.75 | 0.01 | 0.01 | 93.28 | −0.02 | −3.38 | good whiteness |

As is also apparent from the above results,both of No. 4 and No. 6 included in the range of the present invention exhibit good whiteness characteristics.

EXAMPLE 3

Coating composition for receiving layer (B):

| | |
|---|---|
| Polycarbonate (Macrolon #5705, manufactured by Bayer) | 15 wt. parts |
| Epoxy-modified silicone oil (X-22-3000E, manufactured by Shinetsu Kagaku) | 0.3 wt. parts |
| Amino-modified silicone oil (X-22-3050C, manufactured by Shinetsu Kagaku) | 0.3 wt. parts |
| Methylene chloride | 84.4 wt. parts |

An image-receiving sheet was obtained according to the same method as in Example 1 except for using the above coating composition for receiving layer (B) in place of the coating composition for receiving layer (A). Also, the additives shown in the following Table 3 were added in the same manner as in Example 1, and the colorimetric data obtained are shown in Table 3.

TABLE 3

| No. | White pigment (wt. parts) | Blue dye (wt. parts) | Red dye (wt. parts) | L | a | b | Visual Judgement |
|---|---|---|---|---|---|---|---|
| 1 | 0 | 0 | 0 | 94.15 | −1.20 | 2.56 | tinted with yellowishness |
| 2 | 0.75 | 0 | 0 | 95.42 | −0.70 | 3.32 | tinted with yellowishness |
| 3 | 0 | 0.01 | 0 | 93.26 | −4.27 | −4.82 | tinted with blueishness |
| 4 | 0 | 0.003 | 0.003 | 91.07 | −0.15 | −4.01 | good whiteness |
| 5 | 0.75 | 0.01 | 0 | 93.58 | −3.59 | −3.21 | tinted with blueishness |
| 6 | 0.75 | 0.003 | 0.003 | 93.02 | −0.27 | −3.21 | good whiteness |

As is also apparent from the above results, both of No. 4 and No. 6 included in the range of the present invention exhibit good whiteness.

As is also apparent from the results of the above Examples, the heat transfer sheet of the present invention has reflection characteristic values within specific ranges, and therefore has markedly excellent effect in whiteness characteristic.

What is claimed is:

1. An image-receiving sheet to be used in combination with a heat transfer sheet containing a dye which is migrated by melting or sublimation with heat, having a receiving layer for receiving the dye migrated from said heat transfer sheet formed on the surface of the substrate sheet, said receiving layer having dyeability, and the surface reflection characteristics of the surface of the image-receiving sheet where the receiving layer is coated having the values L, a and b as measured by the method defined by JIS-Z8722 and represented by JIS-8730 within the ranges of L=85 or more, a=−1.5 to +2.0, and b=abut −4.0 to 0, respectively.

2. An image-receiving sheet according to claim 1, wherein the receiving layer contains at least one material selected from the group consisting of white pigments, blue dye and red dye.

3. An image-receiving sheet according to claim 1, wherein an intermediate layer is provided between the substrate sheet and the receiving layer.

4. An image-receiving sheet according to claim 3, wherein the intermediate layer contains at least one material selected from the group consisting of white pigments, blue dye and red dye.

5. An image-receiving sheet according to claim 1, further containing the fluorescent brightener.

6. An image-receiving sheet according to claim 1, wherein the surface reflection characteristics of the surface of the substrate sheet have the values L, a and b as measured by the method defined by JIS-Z8722 and represented by JIS-8730 within the range of L=90 or more, a=−2.0 to 2.0, and b=−7.0 to 1.0. respectively.

* * * * *